US005097562A

United States Patent [19]

Tessier

[11] Patent Number: 5,097,562

[45] Date of Patent: Mar. 24, 1992

[54] VERTICAL BLIND CLEANER

[75] Inventor: Omer Tessier, Regina, Canada

[73] Assignee: Tessier Holdings Ltd., Regina, Canada

[21] Appl. No.: 548,817

[22] Filed: Jul. 6, 1990

[51] Int. Cl.[5] ..... A47L 5/38

[52] U.S. Cl. ..... 15/302; 15/302; 15/308; 15/309.2; 134/42

[58] Field of Search ..... 15/77, 102, 302, 308, 15/309.1, 309.2

[56] References Cited

U.S. PATENT DOCUMENTS

| | | | |
|---|---|---|---|
| 3,643,277 | 2/1972 | Durst | 15/77 |
| 4,672,711 | 6/1987 | Mickler | 15/309.1 |
| 4,730,360 | 3/1988 | Brügelmann | 15/102 |

*Primary Examiner*—Theodore Morris
*Assistant Examiner*—Zeinab El-Arini
*Attorney, Agent, or Firm*—Murray E. Thrift; Stanley G. Ade; Adrian D. Battison

[57] ABSTRACT

The fabric strips of vertical blinds are cleaned using a novel method of apparatus. A strip is laid on an elongate tray and wetted with an appropriate washing liquid, e.g. a detergent solution. The strip is then passed along the tray between two counter-rotating brushes which act to scrub the opposite surfaces of the strip. Downstream of the brushes, the strip is sprayed with a rinse liquid. It then travels over a perforated section of the tray where it is subjected to a low pressure from below by a vacuum box communicating with a wet-dry vacuum. The cleaned, partially dry strips can then be hung to complete drying.

1 Claim, 1 Drawing Sheet

VERTICAL BLIND CLEANER

FIELD OF THE INVENTION

The present invention relates to blind cleaning and more particularly to the cleaning of elongate strips such as those used in vertical blinds.

BACKGROUND

The cleaning of badly soiled vertical blinds is extremely difficult and in some cases impossible without damaging the blinds. Manufacturers of the blinds recommend that the fabric strips of the blind be washed by immersion. However, this gives very poor results, especially if the blinds are soiled by hard to remove materials such as tobacco smoke, grease soot. Immersion cleaning usually damages the strips along the edges. Dry cleaning is likewise undesirable. It removes the resin and other materials from the fabric and also damages the edges of the strip because of the tumbling action. This is also very hard on the dry cleaning filter systems.

The present invention is concerned with a novel technique for the satisfactory washing of vertical blind strips.

SUMMARY

According to one aspect of the present invention there is provided a method of cleaning an elongate blind strip comprising;

supporting the strip;

wetting the strip with cleaning liquid;

engaging opposite sides of the strip with respective brushes;

causing relative movement of the brushes and the strip whereby the strip is engaged by the brushes progressively therealong;

applying a rinsing liquid to the strip; and subjecting one side of the strip to a low pressure to draw liquid therefrom.

According to another aspect of the present invention there is provided a cleaner for an elongate blind strip comprising:

means for supporting the blind strip for travel along a linear path;

a pair of counter-rotating rotary brushes mounted respectively above and below the path for engagement with opposite sides of the blind strip as the strip travels along the path;

brush drive means for rotating the brushes in opposite directions;

means for discharging a rinsing liquid onto the strip at a position along the path downstream from the brushes; and vacuum means for applying a low pressure to one side of the strip at a position along the path downstream from the means for discharging a rinsing liquid onto the strip.

This method and apparatus provide an effective cleaning action without damaging the strips. The cleaning time is relatively short because cleaning is done using a brushing technique rather than a tumbling, immersion technique. The concentration of detergents and deodorizers applied to the strips is easily controlled by an operator as these materials are independently applied to the strip upstream of the brushes.

Damage to the fabric is eliminated because the edges of the material are not subject to the tumbling action required for cleaning by dry cleaning or in a conventional laundry washer or dryer.

BRIEF DESCRIPTION OF THE DRAWINGS

In the accompanying drawings which illustrate an exemplary embodiment of the present invention.

DETAILED DESCRIPTION

Figure 1:
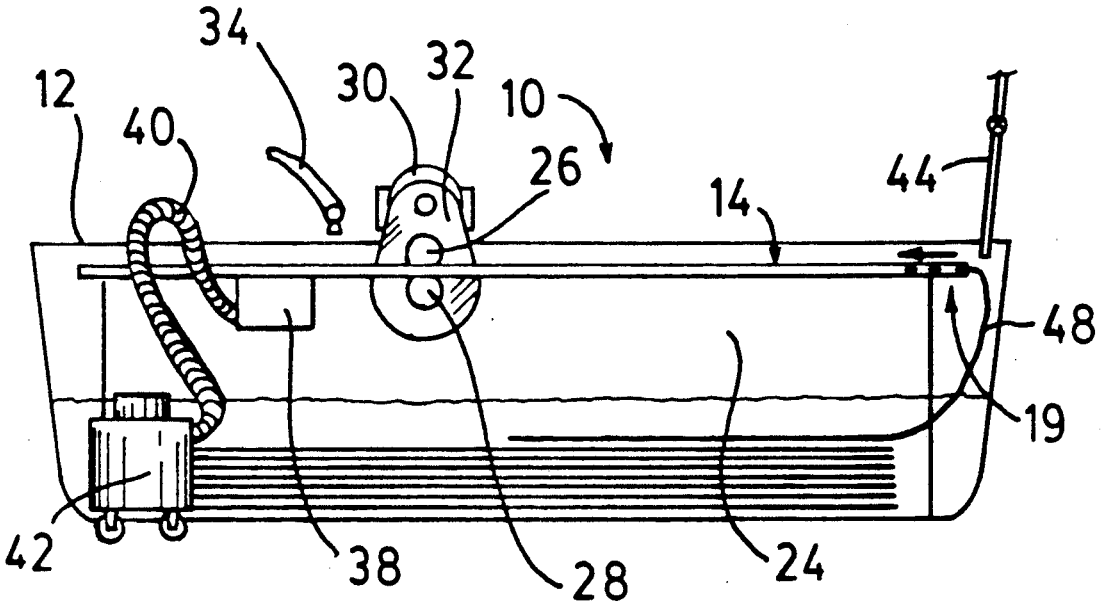
FIG. 1 is a schematic side elevation of the apparatus.
Figure 2:
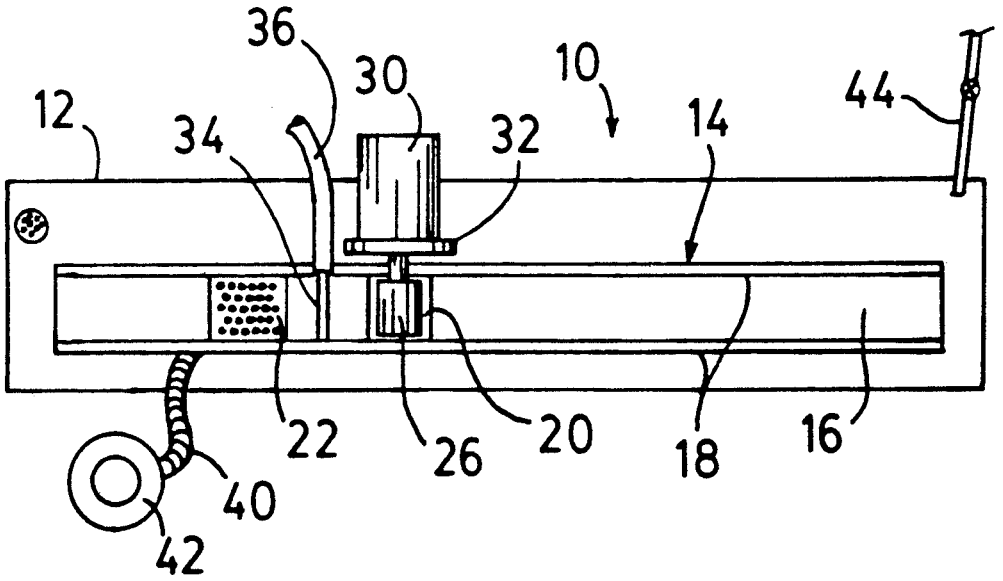
FIG. 2 is a plan view of the apparatus.

Referring to the accompanying drawings, there is illustrated a vertical blind strip cleaner 10. The cleaner is mounted in, or above, a tank 12 which contains a washing solution of water and detergent and catches spilled or splashed cleaning or rinsing liquids. The cleaner includes an elongate tray 14 consisting of a flat web 16 wider than the widest blind strip to be handled and a pair of edge flanges 18 which retain blind strips aligned on the tray. Partway along the strip from the upstream end 19 is a rectangular cut-out 20. Downstream from the cut-out is a perforated section 22 of the web 16. The tray is supported in the tank 12 by a support 24 that also serves to support two counter-rotating rotary brushes 26 and 28 respectively above and below the tray at the cut-out 20. The brushes contact one another through the cut-out. The brushes are driven by a motor 30 through a gearbox 32 that imparts opposite rotation to the two brushes.

A spray head 34 is positioned above the tray, just down the stream of the brushes. It is connected to a clean water supply 36 for spraying rinse water onto a blind strip downstream of the brushes.

Downstream of the spray head 34, below the perforated section 22 of the tray, is a vacuum box 38. This is a closed housing sealed to the bottom of the tray and connected by a hose 40 to a conventional wet-dry vacuum cleaner 42. In other embodiments other vacuum sources may be used. The operation of the vacuum cleaner 42 applies a low pressure to the inside of the vacuum box 38 and thus a low pressure to the underside of a blind strip overlying the perforated section 22 of the tray 14. A second water supply 44 may be used by an operator for filling the tank in which the blind strips to be cleaned are immersed. Detergents, deodorizers or other materials may be added to the wash water.

In operation of the apparatus, a blind strip 48 is slid on the tray 14 upstream of the brushes 26 and 28. The strip immersed in the tank 12 is wetted with a cleaning liquid, for example a detergent solution. The motor is operated to rotate the brushes 26 and 28 and the blind strip is drawn between the counter-rotating brushes. Where it emerges from the downstream side of the brushes, the blind strip is sprayed with a clean rinse water. The cleaned and rinsed blind strip then passes over the perforated section 22 of the tray where a low pressure in the vacuum box 38 draws liquid from the strip so that it is partially dry. The strip may then be taken and hung on an appropriate rack to complete drying.

The blind washing process and apparatus of the invention have proven to provide a simple, effective technique for performing a cleaning task that could not satisfactorily be carried out using the prior art techniques.

While one embodiment of the present invention has been described in the foregoing, it is to be understood that other embodiments are possible within the scope of the invention. For example, it is possible to use more than one pair of brushes, so that each side of a blind strip is scrubbed by a set of brushes. The invention is thus to be considered limited solely by the scope of the appended claims.

I claim:

1. A cleaner for an elongate blind strip comprising:

a tank having an open top;

an elongate tray comprising a web for supporting the blind strip and a pair of spaced apart flange means for guiding the blind strip for travel along a linear path along the web, a brush opening in the web and a perforate section of the web between the brush opening and a downstream end of the tray;

a pair of rotary brushes mounted respectively above and below the path for engagement with opposite sides of the blind strip as the strip travels along the path a lower one of the said brushes projecting into the brush opening in the web;

brush drive means for rotating the brushes in opposite directions;

rinse means for discharging a rinsing liquid onto the strip at a position along the path between the brushes and the perforate section of the web;

vacuum means for applying a lower pressure to the strip through the perforate section of the web; and support means supporting the tray, the brushes and the rinse means in the open top of the tank.

* * * * *